US009845638B1

(12) United States Patent
Cunningham

(10) Patent No.: US 9,845,638 B1
(45) Date of Patent: Dec. 19, 2017

(54) GARAGE DOOR STOP MOULD

(71) Applicant: Chris Cunningham, Louisville, KY (US)

(72) Inventor: Chris Cunningham, Louisville, KY (US)

( * ) Notice: Subject to any disclaimer, the term of this patent is extended or adjusted under 35 U.S.C. 154(b) by 0 days.

(21) Appl. No.: 15/375,129

(22) Filed: Dec. 11, 2016

(51) Int. Cl.
*E06B 7/22* (2006.01)
*E06B 7/23* (2006.01)
*E06B 7/16* (2006.01)
*E06B 7/232* (2006.01)

(52) U.S. Cl.
CPC ..... *E06B 7/2307* (2013.01); *E06B 7/16* (2013.01); *E06B 7/22* (2013.01); *E06B 7/232* (2013.01)

(58) Field of Classification Search
CPC .... E06B 7/2314; E06B 7/2316; E06B 7/2305; E06B 7/2307; E06B 7/231; E06B 7/22; E06B 1/522
USPC ..... 49/489.1
See application file for complete search history.

(56) References Cited

U.S. PATENT DOCUMENTS 3,378,958 A * 4/1968 Parks ..... E06B 7/231 49/489.1
4,690,862 A 9/1987 Hoffmann
5,009,036 A * 4/1991 Ryan ..... E06B 7/231 49/475.1
5,174,065 A * 12/1992 Schlicht ..... E06B 7/2312 49/470
5,435,104 A * 7/1995 Dietrich ..... B60J 5/14 49/475.1
5,544,690 A * 8/1996 Magro ..... E06B 9/11 160/133
5,577,349 A * 11/1996 Rissone ..... E06B 7/16 49/306
5,758,458 A * 6/1998 Ridge ..... E06B 1/045 49/504
5,784,834 A 7/1998 Stutzman
6,129,130 A 10/2000 Rekret
6,167,657 B1 1/2001 Burge et al.
6,360,489 B1 3/2002 Burge et al.
6,374,567 B1 * 4/2002 Mullet ..... E06B 3/485 160/201
6,772,560 B2 8/2004 Dischiant et al.
6,772,561 B1 8/2004 Berger, Jr.
8,881,464 B1 * 11/2014 Huckeba ..... E06B 7/231 49/197
9,045,937 B2 6/2015 Peck et al.
9,068,391 B2 6/2015 Peck et al.
2005/0000165 A1 1/2005 Dischinat et al.
2012/0304543 A1 12/2012 Preising, Jr. et al.
2014/0259954 A1 * 9/2014 Peck ..... E06B 7/16 49/489.1
2017/0218689 A1 * 8/2017 Boer ..... E06B 7/22 49/493.1

* cited by examiner

*Primary Examiner* — Justin Rephann
(74) *Attorney, Agent, or Firm* — Brian W. Foxworthy; Robert R. Waters; Waters Law Group, PLLC

(57) ABSTRACT

A garage door stop mold comprises a base and a seal strip. The base mounts to a door jamb near a garage door opening. The seal strip attaches to the base. Tabs on the bottom surface of the seal strip insert into grooves extending from the base to attach the seal strip to the base. The seal strip has a door seal edge and a jamb seal edge. The door seal edge seals against a garage door when the door is closed and the jamb seal edge seals against the jamb.

19 Claims, 3 Drawing Sheets

GARAGE DOOR STOP MOULD

FIELD OF THE INVENTION

This invention relates to sealing around external doors. More specifically, this invention relates to weather stripping or flashing for providing a seal around garage doors.

BACKGROUND OF THE INVENTION

Most garage doors consist of panels guided by wheels in rails. A series of panels have rollers on them which ride in the rails. At one end, the rails terminate close to the floor near the door opening. At the other end the rails terminate above the door opening. The panels are guided into position by the rollers and rails to cover the door opening. When the garage door is opened, the rollers and rails guide the panels away from the garage door opening to a position out of the way.

The size of the door opening and the manner in which the roller and rails bring the panels into the closed position have led to special products for sealing between the building structure, or door frame, and the door panel, or panels. These products are comprised of a firm elongated strip having a rectangular cross section and a soft flap extending along the length of the strip. The firm strip is placed on the structure of the building in a position for the soft flap to contact the garage door. U.S. Pat. Nos. 6,167,657 and 6,360,489 by Burge, et al., disclose such weather stripping.

Although current products provide an adequate seal between the door frame and the door, they require manual sealing at the external edge of the firm strip and also have cosmetic issues. When the weather strip is installed, a bead of caulking is applied along the edge of the weather strip that faces away from the garage door. This is a manual operation and requires a certain level of skill to apply the caulking effectively and efficiently. Removing this step from the installation process would greatly increase the speed with which the weather stripping could be installed which would result in a substantial labor cost savings.

In addition to the issue of installation, current products present cosmetic issues. The strips are installed with fasteners such as nails and screws. The weather stripping comes in colors to match the doors, or door frames, or both. To prevent the head of the fasteners from being obviously visible against the color of the weather strip, the fasteners must match the color of the weather strip, or the fastener and weather strip must be painted. If the fasteners match the color of the weather strip, fasteners that match the color of weather strip must be kept on hand. Keeping matching fasteners for each possible color of weather strip leads to an inventory problem. Either a large inventory of fasteners must be kept or a mismatch of colors will occur. This is not cosmetically acceptable to end customers. Alternatively, if the weather stripping and fasteners are painted, this is an additional labor and material cost. Frequently, even when a fastener initially has a coating matching the color of the weather strip, it lasts only to the time of installation. For nails, a few strikes of a hammer can remove the coating, and for screws, a slip of the driver can remove the coating. Finally, even if the weather stripping and fasteners match in color initially and the coating survives installation, extended exposure to weather can oxidize fasteners. For strength and cost effectiveness, fasteners typically contain some iron alloy. Extended exposure can change the color of the fasteners and cause them to stand out visually from the weather stripping, or the oxidation may cause streaks to run from the fasteners and cause even more visible discoloration of the weather stripping.

RELEVANT ART

U.S. Pat. No. 9,068,391 by Peck, et al., is for "Adjustable garage door jamb trim." In Peck '391, an adjustable garage door jamb trim system includes an interior door jamb trim, and an exterior door jamb trim. The interior door jamb trim and exterior door jamb trim are secured to a door jamb. The interior door jamb trim and exterior door jamb trim form an adjustable mating configuration that seal the interface between the interior door jamb trim and the exterior door jamb trim when the interior door jamb trim and exterior door jamb trim are secured to a door jamb having a width within a given range of widths.

U.S. Pat. No. 9,045,937 by Peck, et al., is for a "Garage door stop and seal system." In Peck '937, a garage door stop and seal system is disclosed. The door stop and seal system of Peck '937 is intended to allow for expansion and contraction, enable replacement of the seal, and provide hidden, or concealed, fasteners. The system includes a door stop that removeably snaps into a receiver, wherein the door stop conceals the fasteners used to connect the receiver to a door jamb. Additionally, the door stop includes a receiving space for a replaceable seal. The replaceable seal presses against a garage door to seal the gap between the door jamb and the garage door when the garage door is shut.

U.S. Pat. No. 6,772,560 by Dischiant, et al., is for a "WEATHER STRIP FOR DOORS". Dischiant discloses a sealing device for a garage door for sealing the door and frame to exclude the elements. A first part, or base, mounts to a supporting surface such as a door jamb. A second part is constructed to removeably attach to the first part. The second part carries a sealing element. The sealing element presses against the garage door to create a seal.

As may be seen from relevant art, there remains a need for a weather strip that provides sealing at both the internal and external edges without additional labor and which is more cosmetically pleasing by eliminating exposed fasteners from the exterior surface.

SUMMARY FOR EMBODIMENTS OF THE INVENTION

Embodiments of the weather stripping for garage doors are comprised of an elongated base with a first flexible strip along a top edge, or corner, of the base and a second flexible strip along the side of the base opposite to the first flexible strip. The first flexible strip extends upward and outward from the base to contact a garage door in its closed position to provide a seal around the garage door. The second flexible strip extends downward and outward from the base to seal against the structure to which the base is attached. The second flexible strip provides a seal near the external edge of the base.

BRIEF DESCRIPTION OF THE DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS

Figure 2:
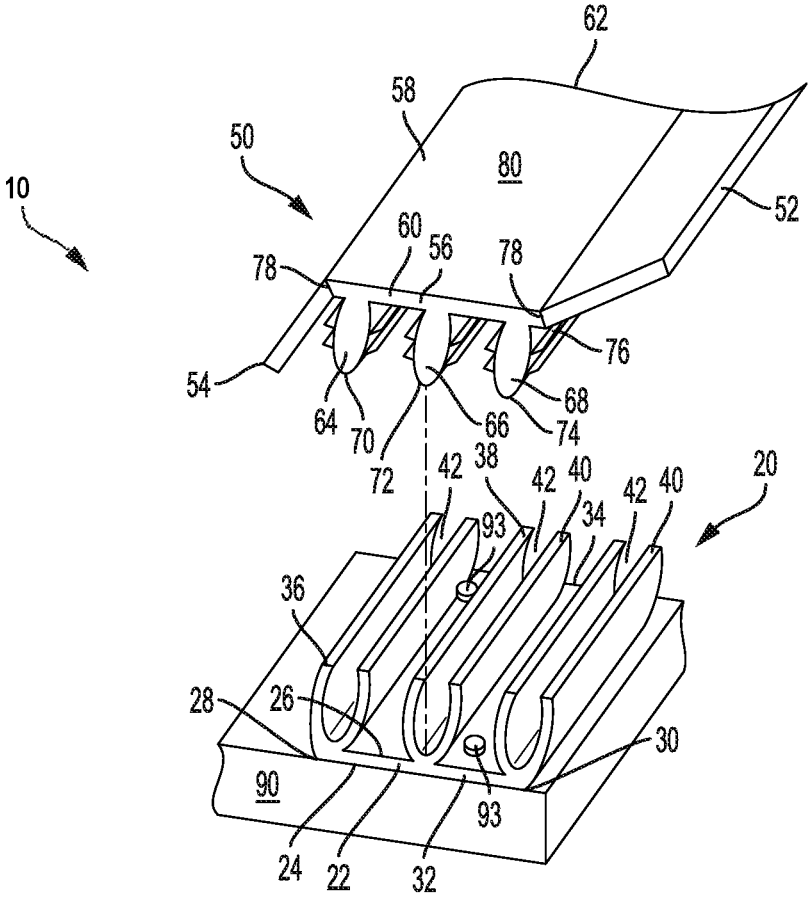
FIG. 2 is a perspective view of an embodiment of a garage door stop mould with the base mounted and the seal strip in position above the base.
Figure 3:
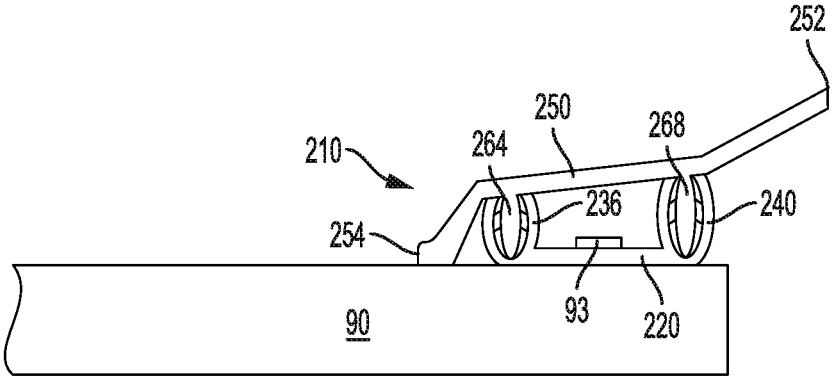
FIG. 3 is an end view of an embodiment of a garage door stop mould mounted in position.
Figure 4:
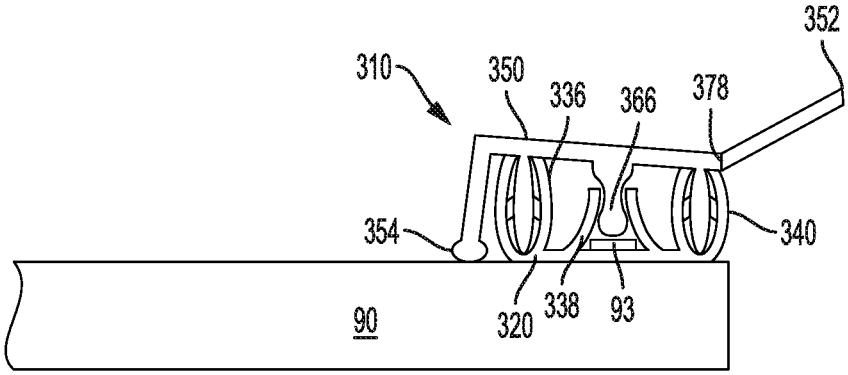
FIG. 4 is an end view of an embodiment of a garage door stop mould mounted in position.

In the following detailed description, similar elements are numbered with similar numbers. Although there are differences between the embodiments of FIG. 1 and FIG. 2, like numbers are used for similar elements. In FIG. 3, a two-hundred series of numbers is used for similar elements. In FIG. 4, a three-hundred series of numbers is used for similar elements.

Figure 1:
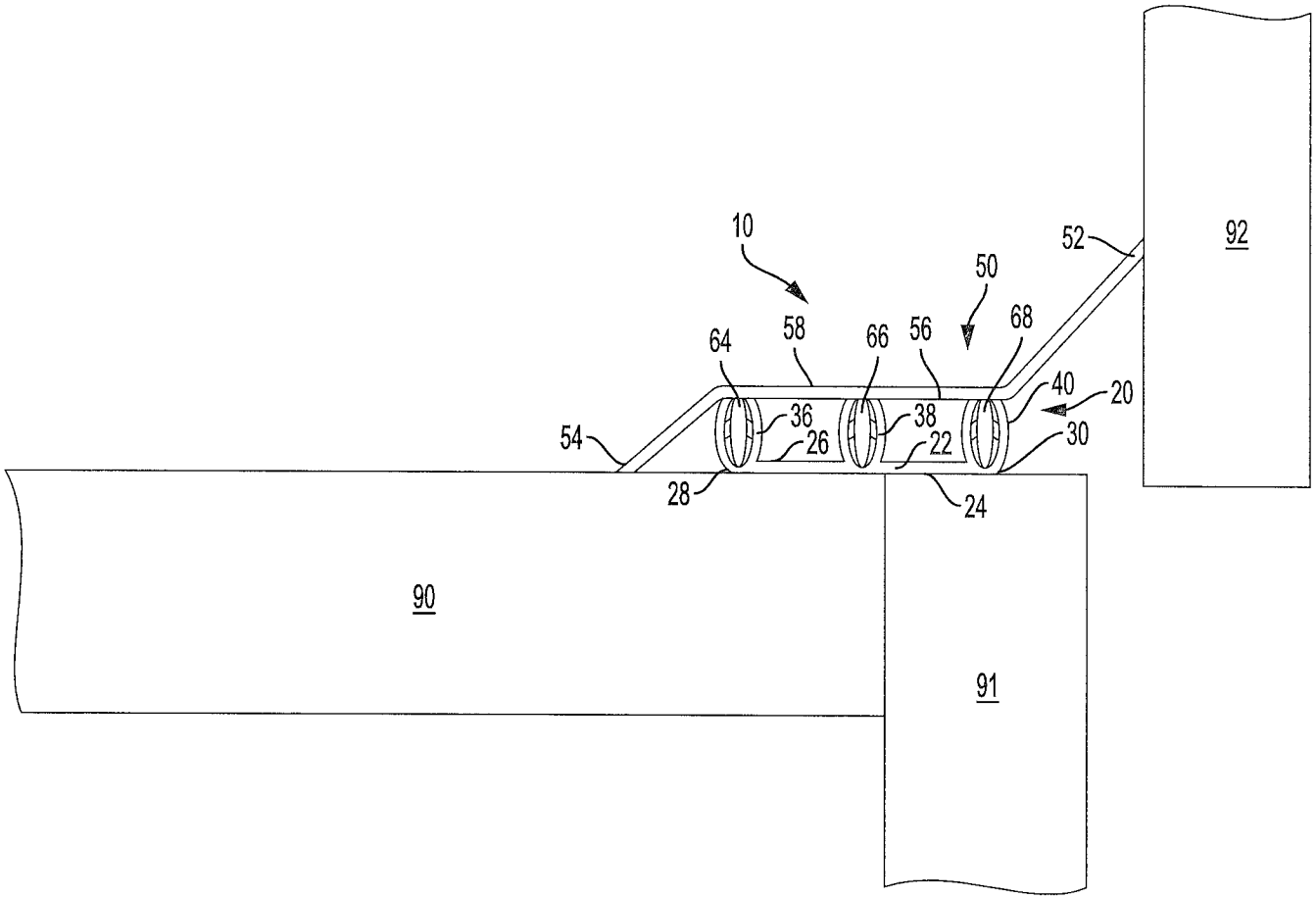
FIG. 1 is an end view of an embodiment of a garage door stop mould mounted in position.

FIG. 1 is an end view of an embodiment of a garage door stop mould 10 mounted in position. FIG. 1 shows a profile, or shape, which extends the length of door stop mould 10. FIG. 2 is a perspective view of an embodiment of a garage door stop mould 10 with base 20 mounted and seal strip 50 in position above base 20. FIG. 2 illustrates the profiles of base 20 and seal strip 50 extending the length of door stop mould 10. Referring to both FIGS. 1 and 2, base 20 of garage door stop mould 10 is attached to door jamb 90 and casing 91 proximal to garage door 92. In FIG. 1, seal strip 50 is connected to base 20, and seal strip 50 has a door seal edge 52 and a jamb seal edge 54 opposite to door seal edge 52. Door seal edge 52 is configured to seal against garage door 92 when seal strip 50 is mounted to base 20 and garage door 92 is closed. Jamb seal edge 54 is configured to seal against door jamb 90 when seal strip 50 is mounted to base 20. In the embodiment of FIG. 1, in particular, the far edges of seal strip 50 are angled to better seal against the respective surfaces.

Panel 22 of base 20 has a bottom surface 24, a top surface 26, two opposing edges 28 and 30, and two opposing ends 32 and 34. Ends 32 and 34 in FIG. 2 define the length of base 20. In FIG. 2, base 20 is depicted as being relatively short. However, base 20 can be long enough to match the length needed to frame a garage door, or alternatively multiple sections of base 20 can be combined to achieve a desired length.

In the embodiment shown in FIGS. 1 and 2, seal strip 50 attaches to base 20 at three locations. Three grooves 36, 38, 40 extend from top surface 26 of base 20. Grooves 36, 38, 40 have openings 42 at their tops and are closed where they join panel 22. In the embodiments shown in FIGS. 1 and 2, grooves 36 and 40 are proximal to first and second edges 28, 30 and in those embodiments, define sides of base 20.

Seal strip 50 has a bottom surface 56 and a top surface 58. Ends 60 and 62 in FIG. 2 define a length of seal strip 50. Tabs 64, 66, 68 extend from bottom surface 56 of seal strip 50. Tabs 64, 66, 68 are generally centrally located on bottom surface 56 of seal 50 and spaced to align with grooves 36, 38, 40 of base 20. In the embodiments shown in FIGS. 1 and 2, grooves 36, 38, 40 and tabs 64, 66, 68 are arranged and spaced generally symmetrically. Grooves 36, 38, 40 are approximately the same height, and tabs 64, 66, 68 are approximately the same height. Other embodiments may not be symmetric and may have variance among their grooves and tabs.

Grooves 36, 38, 40 and tabs 64, 66, 68 are configured such that when tabs 64, 66, 68 of seal strip 50 are inserted into grooves 36, 38, 40 of base 20, seal strip 50 is maintained fixed to base 20. In the embodiments shown in FIGS. 1 and 2, grooves 36, 38, 40 have smaller openings 42, 44, 46 at their tops and larger cross-sections below. Tabs 64, 66, 68 have smaller tips 70, 72, 74 and larger cross-sections above. Smaller tips 70, 72, 74 facilitate the insertion of tabs 64, 66, 68 into openings 42, 44, 46 of grooves 36, 38, 40. The larger cross-sections of grooves 36, 38, 40 and tabs 64, 66, 68 compliment each other to retain tabs 64, 66, 68 in grooves 36, 38, 40. Grooves 36, 38, 40 and tabs 64, 66, 68 are made of material sufficiently resilient to maintain seal strip 50 on base 20. In particular, grooves 36, 38, 40 are made of material sufficiently resilient to resist excessive flexing and resulting expansion of openings 42, 44, 46. In some embodiments, grooves 36, 38, 40 and tabs 64, 66, 68 are made of different material.

As shown in FIG. 2, in some embodiments, tabs 64, 66, 68 may have ribs 76 running along their lengths. Ribs 76 provide additional gripping force between tabs 64, 66, 68 and grooves 36, 38, 40, while also allowing less precise manufacturing standards in the fit between grooves 36, 38, 40 and tabs 64, 66, 68. Ribs 76 typically extend from the sides of tabs 64, 66, 68 are of the same material as tabs 64, 66, 68.

Additionally, both base 20 and seal strip 50 may have different sections of their parts made of different materials. In FIG. 2, seal strip 50 has seams 78 to each side of a central section 80. Seams 78 denote a change in material from central section 80 to door seal section 82 and jamb seal section 84. The production of base 20 and seal strip 50 with different materials in different sections may be accomplished by co-extrusion of the different sections, among other production processes. The embodiment of FIG. 2, with its sections comprising different materials, may be contrasted with the embodiment of FIG. 1. In FIG. 1, seal strip 50 is continuous and without seams from door seal edge 52 to jamb seal edge 54. In the embodiment of FIG. 1, seal strip 50 is shaped outside the width of tabs 64 and 68 to have door seal edge 52 seal against garage door 92 jamb seal edge 54 seal against jamb 90.

Base 20 can be attached to jamb 90 in any way deemed appropriate by the installer. In FIG. 2, heads of fasteners 93 are visible. Fasteners 93 may be nails or screws. In the embodiment of FIG. 2, base 20 has groove 38 along its centerline. Therefore, fasteners 93 are offset from center and staggered along the length of base 20. Referring back to FIG. 1, it may be seen that, in some cases, the ability to place fasteners off-center will allow an installer to avoid crevasses in the underlying structure. This greatly increases the staying power and rigidity of the installation. In other applications, an installer may use an adhesive. In still other applications, it is possible that an additional substrate could be mounted to jamb 90 to provide a quick mount for base 20. The substrate would be structured to receive base 20 and may have other features relating to framing a garage door.

FIG. 3 is an end view of an embodiment of a garage door stop mould 210 mounted in position. In the embodiment of FIG. 3, base 220 has two grooves 236, 240 spaced to each side of base 220. With only two grooves, base 220 can be attached to jamb 90 with fasteners in the middle of base 220. Grooves 236, 240 are not the same height, with groove 236 being shorter than groove 240. Seal strip 250 has two tabs 264 and 268 spaced to match grooves 236 and 240. With groove 236 being shorter than groove 240, the section of seal strip 250 between tab 264 and jamb seal edge 254, which is distal from garage door 92, can be shorter. This can improve the seal between jamb seal edge 254 and jamb 90 since that section deflects less over the shorter length. In the embodiment shown in FIG. 3, the distal section leading to jamb seal edge 254 is also thicker to provide further stiffness.

In the embodiment of seal strip 250 of FIG. 3, the section of seal strip 250 proximal to garage door 92 between tab 268 and door seal edge 252 is longer and more flexible than the distal section of seal strip 250. This is similar to the embodiments of FIGS. 1 and 2, and allows door seal edge 252 to seal against a movable garage door when it is closed. Seal strip 250 of FIG. 3 may also be made of different material in different sections to provide differences in stiffness. For example, it may be desirable that the section of seal strip 250 distal from the garage door be stiffer to seal against jamb 90, while it may be desirable that the section of seal strip 250 proximal to a garage door be more pliable to seal against the garage door but not scratch it from repeated sliding contact.

Still referring to FIG. 3, with groove 236 being shorter than groove 240, base 220 is not symmetrical. This requires that base 220 be mounted with a particular orientation. The groove of base 220 that will support the part of seal strip 250 that will extend to seal against a garage door must be positioned proximal to the garage door.

FIG. 4 is an end view of an embodiment of a garage door stop mould 310 mounted in position. In the embodiment of FIG. 4, base 320 has three grooves 336, 338, 340. In FIG. 4, groove 338 is shaped to accommodate a fastener 93 at the center. Groove 338 has a flat bottom and its sides are shaped to facilitate the insertion of fastener 93 and the insertion and retention of center tab 366 of seal strip 350. The shape of center tab 366 may be different than tabs 364 and 368 to either side on seal strip 350. Center tab 366 may have a more bulbous, flatter end to accommodate fastener 93 and still provide holding action.

In addition to the shape of center tab 366, seal strip 350 has other unique features. Seal strip 350 has seam 378 between door seal edge 352 and the center section that has tabs 364, 366, 368 extending from its bottom surface 356. Seam 378 indicates a change in material from door seal edge 352, proximal to the garage door, and the center section of door seal strip 350. In the embodiment of FIG. 4, the distal section of seal strip 350, which has jamb seal edge 354, turns down sharply to contact jamb 90 and provide a seal at the distal side of garage door stop mould 310.

Garage door stop mould 10, 210, 310 may be made by any applicable processes and materials. However, a common process used for items having a consistent profile over the length of the article is extrusion. Materials which may be used in an extrusion process include: extruded flexible vinyl; Polyvinyl Chloride (PVC); polypropylene; and plastics in general. As discussed above, some embodiments of seal strip 50, and/or base 20 may be composed of more than one material. For these embodiments, a coextrusion process may be used to create a profile that has different materials in different sections. Coextrusion is known in the art. Other materials that may be used include fiber reinforced polymeric materials (FRP), e.g. pultruded fiberglass and acrylonitrile-butadiene-styrene (ABS). Pultrusion is a process known in the art, as are pultruded materials. The materials used may be colored during production with dyes, or alternatively, the materials used may be paintable materials.

It is to be understood that the embodiments and arrangements set forth herein are not limited in their application to the details of construction and arrangement of the components set forth in the description and illustrated in the drawings. Rather, the description and the drawings provide examples of the embodiments envisioned, but the invention is not limited to the specific embodiments. The embodiments disclosed herein are further capable of other embodiments and of being practiced and carried out in various ways, including various combinations and sub-combinations that may not have been explicitly disclosed. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the invention be regarded as including such equivalent constructions.

I claim:

1. A garage door sealing system for attachment to a garage door jamb proximal to a garage door, said sealing system comprising:

a base comprising a bottom surface, a top surface opposite said bottom surface, a first edge, a second edge opposite said first edge and generally parallel to said first edge, a first end, and a second end opposite said first end, said first and second ends defining a length of said base, said base further comprising a first groove extending upward from said top surface and a second groove extending upward from said top surface, said first groove being proximal to said first edge and approximately the length of said base and said second groove being proximal to said second edge and approximately the length of said base;

a seal strip, said seal strip being wider than said base and having a top surface, a bottom surface opposite said top surface, a door seal edge, a jamb seal edge opposite said door seal edge and generally parallel to said door seal edge, a first end, and a second end opposite said first end, said first and second ends defining a length of said seal strip, said seal strip further comprising a first tab extending from said bottom surface of said seal strip and a second tab extending from said bottom surface of said seal strip, said first tab and second tab being generally parallel and spaced to align with said first and second grooves on said top surface of said base;

said first and second grooves and said first and second tabs being configured to maintain said seal strip on said base when said first and second tabs are inserted into said first and second grooves;

said door seal edge being configured to extend and seal against the garage door when said sealing system is mounted to the garage door jamb proximal to the garage door and the garage door is closed; and, said jamb seal edge being configured to extend and seal against the garage door jamb when said sealing system is mounted to the garage door jamb.

2. The garage door sealing system of claim 1, wherein:

said base further comprises a third groove extending upward from said top surface of said base, said third groove intermediate of said first and second grooves; and, said seal strip further comprises a third tab extending from said bottom surface of said seal strip, said third tab being approximately the length of said seal strip and located to insert into said third groove when said first and second tabs are inserted into said first and second grooves, said third groove and said third tab being configured to maintain said seal strip on said base when said first, second, and third tabs are inserted into said first, second, and third grooves.

3. The garage door sealing system of claim 1, wherein:
said first groove is taller than said second groove and said base is mounted on the door jamb with said first groove proximal to the garage door.

4. The garage door sealing system of claim 1, wherein:
said seal strip is comprised of longitudinal sections, said longitudinal sections comprising a central section, a door seal section, and a jamb seal section;
said central section having a proximal edge and a distal edge, said first and second tabs extending from the bottom surface of said central section;
said door seal section comprising said door seal edge and a fixed edge, said fixed edge of said door seal section being joined to said proximal edge of said central section; and,
said jamb seal section comprising said jamb seal edge and a fixed edge, said fixed edge of said jamb seal section being joined to said distal edge of said central section.

5. The garage door sealing system of claim 4, wherein:
said central section is comprised of a different material than said door seal section and said jamb seal section.

6. The garage door sealing system of claim 5, wherein:
said central section is comprised of a material that is firmer than said door seal section and jamb seal section.

7. The garage door sealing system of claim 5, wherein:
said seal strip is produced by coextrusion.

8. The garage door sealing system of claim 4, wherein:
said jamb seal section is comprised of a different material than said door seal section.

9. The garage door sealing system of claim 8, wherein:
said jamb seal section is comprised of a material that is firmer than said door seal section.

10. The garage door sealing system of claim 1, wherein:
said base and seal strip are produced by extrusion.

11. A garage door sealing system for attachment to a garage door jamb proximal to a garage door, said sealing system comprising:
a base comprising a bottom surface, a top surface opposite said bottom surface, a first edge, a second edge opposite said first edge, a first end, and a second end opposite said first end, said first and second edges being generally parallel, and said first and second ends defining a length of said base, said base further comprising a first groove extending upward from said top surface and a second groove extending upward from said top surface, said first groove being proximal to said first edge and approximately the length of said base and said second groove being proximal to said second edge and approximately the length of said base;
a seal strip, said seal strip being wider than said base and comprising a central section having a top surface, a bottom surface, an interior edge, an exterior edge opposite said interior edge, a first end, and a second end opposite said first end, said first and second ends defining a length of said seal strip, said seal strip further comprising a door seal section, said door seal section having a fixed edge and a free edge, said fixed and free edge of said door seal section being generally parallel, said fixed edge of said door seal section being attached to said interior edge of said central section, said seal strip further comprising a jamb seal section, said jamb seal section having a fixed edge and a free edge, said fixed and free edge of said jamb seal section being generally parallel, said fixed edge of said jamb seal section being attached to said exterior edge of said central section, said seal strip further comprising an interior tab extending from said bottom surface of said central section of said seal strip and an exterior tab extending from said bottom surface of said central section of said seal strip, said interior tab and exterior tab being generally parallel and spaced to align with said first and second grooves on said top surface of said base;
said first and second grooves and said interior and exterior tabs being configured to maintain said seal strip on said base when said interior and exterior tabs are inserted into said first and second grooves;
said door seal section being configured to seal against the garage door when said sealing system is mounted to the garage door jamb proximal to the garage door and the garage door is closed; and, said jamb seal section being configured to seal against the garage door jamb when said sealing system is mounted to the garage door jamb.

12. The garage door sealing system of claim 11, wherein:
said base further comprises a third groove extending upward from said top surface of said base, said third groove intermediate of said first and second grooves; and,
said seal strip further comprises an intermediate tab extending from said bottom surface of said seal strip, said intermediate tab being approximately the length of said seal strip and located to insert into said third groove when said interior and exterior tabs are inserted into said first and second grooves, said third groove and said intermediate tab being configured to maintain said seal strip on said base when said interior, exterior, and intermediate tabs are inserted into said first, second, and third grooves.

13. The garage door sealing system of claim 11, wherein:
said first groove is taller than said second groove and said base is mounted on the door jamb with said first groove proximal to the garage door.

14. The garage door sealing system of claim 11, wherein:
said central section is comprised of a different material than said door seal section and said jamb seal section.

15. The garage door sealing system of claim 14, wherein:
said central section is comprised of a material that is firmer than said door seal section and jamb seal section.

16. The garage door sealing system of claim 14, wherein:
said seal strip is produced by co-extrusion.

17. The garage door sealing system of claim 11, wherein:
said jamb seal section is comprised of a different material than said door seal section.

18. The garage door sealing system of claim 17, wherein:
said jamb seal section is comprised of a material that is firmer than said door seal section.

19. The garage door sealing system of claim 11, wherein:
said base and seal strip are produced by extrusion.

* * * * *